US007357179B2

(12) United States Patent
Zheng et al.

(10) Patent No.: US 7,357,179 B2
(45) Date of Patent: Apr. 15, 2008

(54) METHODS OF USING COILED TUBING INSPECTION DATA

(75) Inventors: Shunfeng Zheng, Houston, TX (US); Sarmad Adnan, Sugar Land, TX (US); John R. Lovell, Houston, TX (US); Aude Faugere, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 310 days.

(21) Appl. No.: 11/212,047

(22) Filed: Aug. 25, 2005

(65) Prior Publication Data

US 2006/0096753 A1 May 11, 2006

Related U.S. Application Data

(60) Provisional application No. 60/625,681, filed on Nov. 5, 2004.

(51) Int. Cl.
*E21B 47/00* (2006.01)

(52) U.S. Cl. ..... 166/250.01

(58) Field of Classification Search ..... None
See application file for complete search history.

(56) References Cited

U.S. PATENT DOCUMENTS 5,826,654 A 10/1998 Adnan et al. ..... 166/250.01
5,914,596 A 6/1999 Weinbaum ..... 324/228
6,450,259 B1 * 9/2002 Song et al. ..... 166/255.1

FOREIGN PATENT DOCUMENTS

EP 0 803 638 10/1997

OTHER PUBLICATIONS

SPE 81722, *A New Approach To Ultrasonic Coiled Tubing Inspection* by Kenneth R. Newman and John Lovell.
SPE 36336, *Coiled Tubing Deformation Mechanics: Diametral Growth and Elongation* by Steven Tipton.
SPE 46023, Results From NDE Inspections Of Coiled Tubing by Rideric K.Stanley.

* cited by examiner

*Primary Examiner*—Zakiya W Bates
(74) *Attorney, Agent, or Firm*—Rodney Warfford; David Cate; Robin Nava

(57) ABSTRACT

Methods for generating geometric databases of coiled tubing inspection data and using the data in job design, real time monitoring and automated feedback control of operations are described. One method includes creating a grid of spatial positions on a length of coiled tubing as it traverses through an inspection apparatus having a plurality of sensors for detecting defects in the coiled tubing. Real time data may be compared to historical or nominal data for the coiled tubing. Another method includes monitoring, in real time or near real time, the status of tubing dimension (thickness, diameter, ovality, shape) during a coiled tubing operation, such as acidizing, fracturing, high pressure operations, drilling, and wellbore cleanouts. This abstract allows a searcher or other reader to quickly ascertain the subject matter of the disclosure. It will not be used to interpret or limit the scope or meaning of the claims.

25 Claims, 4 Drawing Sheets

METHODS OF USING COILED TUBING INSPECTION DATA

This non-provisional patent application claims priority to provisional application Ser. No. 60/625,681 filed Nov. 5, 2004.

BACKGROUND OF THE INVENTION

1. Field of Invention

The present invention relates generally to the field of inspection of ferrous tubular members, and more specifically to inspection of coiled tubing apparatus and methods of using the data from such inspections.

2. Related Art

Through the service life of a coiled tubing string (during its storage, transportation and workover operations), the mechanical integrity of the coiled tubing, such as tension capacity, fatigue life, burst or collapse pressure resistance, is constantly changing as a result of coiled tubing geometrical changes. For example, acidizing through coiled tubing could cause coiled tubing corrosion, while corrosion could lead to wall thickness loss or pitting on the surface of the coiled tubing; fracturing through coiled tubing could cause erosion on the coiled tubing surface, leading to significant wall thickness loss; high pressure coiled tubing operation could lead to ballooning (increase of outside diameter) and wall thinning; even during normal workover operation, the cross section of coiled tubing will gradually become oval and the length of coiled tubing may gradually grow. All these changes in coiled tubing geometry (wall thickness, diameter, shape) could compromise the mechanical integrity and the operability of the coiled tubing. For example, loss of wall thickness could lead to catastrophic failure of tubing parting, while a balloon section of coiled tubing could get stuck or crushed at the injector. Methods of using coiled tubing inspection data to improve coiled tubing operations are desired to address these needs.

Moreover, for many applications, it is not sufficient to make a single measurement or set of measurements at a single point along the coiled tubing. Tapered strings are known in the industry, for example, wherein the coiled tubing is manufactured with a steadily decreasing wall thickness from one end of the tubing to the other. It is also known in the industry to weld together lengths of coiled tubing. This can be done as an inexpensive approximation to a tapered string. It can also be done as a remedial activity as a way to remove a damaged section of tubing. Knowledge of the geometrical properties of the coil along the length of the tubing can also be used to better infer the friction as the coiled tubing is pushed into a wellbore. Knowledge of the change of such geometrical properties over time can be used to better estimate fatigue and useful life of the coiled tubing.

In addition, coiled tubing is known to experience gradual increase of permanent elongation through services. The amount of permanent elongation may not be uniform through the entire coiled tubing string. Hence, knowledge of simple diameter or wall thickness measurements relative to the length of coiled tubing may not be sufficient, especially for a tapered coiled tubing string. In many cases, knowledge of general geometry measurements (diameter, wall thickness, defects, etc, with a length reference) and its corresponding attributes in the original new (as manufactured) form are needed to better estimate the integrity of the coiled tubing.

For these reasons, it is clear that there is a need to make geometric measurements of the coiled tubing along the length of the coiled tubing and to store such measurements in a database that can be readily accessed. Moreover, there is a need to be able to manipulate such databases, for example to append two databases into one when two sections of coil are welded together, or to update a database if a section of tubing is removed. We refer to such a database as a geometric database. The database will typically be indexed by the distance along the coiled tubing but other indexing methods are known in the art.

SUMMARY OF THE INVENTION

In accordance with the present invention, methods of using inspection data for coiled tubing are described that reduce or overcome problems in previously known methods.

A first aspect of the invention is a method comprising:

(a) establishing a geometric database of coiled tubing inspection data; and (b) using the geometric database in designing coiled tubing services.

Another aspect of the invention is a method comprising:

(a) monitoring, in real time or near real time, one or more coiled tubing parameters during a coiled tubing operation; and (b) using change or lack of change in the one or more parameters to identify potential defects on the coiled tubing.

Still another method of the invention comprises:

(a) establishing a geometric database for a coiled tubing string using measurement data;

(b) monitoring one or more tubing dimension parameters in real time during a coiled tubing operation;

(c) using the real time measurements to identify potential defects on the coiled tubing; and (d) using the geometric database and real time measurements to evaluate the criticality of the defect with regard to the coiled tubing operation.

Another method of the invention comprises:

(a) establishing a geometric database for a coiled tubing string using measurement data during a coiled tubing operation; and (b) using the geometric database in real time to modify parameters of the coiled tubing operation, optionally in conjunction with other real time operation parameters, to predict and anticipate potential operation risks and to use feedback control to reduce or eliminate such operation risks.

Still another method of the invention comprises:

(a) establishing a geometric database of coiled tubing inspection data; and (b) using the geometric database for designing coiled tubing services, wherein the services are selected from fracturing, acidizing, coiled tubing drilling, and clean-out.

Still another method of the invention comprises:

(a) establishing a geometric database of coiled tubing inspection data; and (b) updating the database during the life of the coiled tubing.

Still another method of the invention comprises:

(a) evaluating previous evolution of a geometric database between successive or different job runs; and (b) using knowledge of the previous evolution to estimate future evolution of the geometric database for future operations, and optionally using the estimate to determine the suitability of a coiled tubing string for any new operation.

Methods of the invention include, but are not limited to, those methods wherein establishing a geometric database comprises creating a grid of spatial measurement values on a length of coiled tubing as the coiled tubing traverses through an inspection apparatus having a plurality of sensors for detecting defects in the coiled tubing or measuring coiled tubing geometry. The geometric database may cover all or part of a coiled tubing string. Other embodiments include collecting data from coiled tubing selected from: one or a plurality of length attributes that identify the exact location (thereafter "section") along the coiled tubing string where the geometry attributes belong to; one or a plurality of wall thickness attributes which are obtained from the measurements along the circumference of the coiled tubing section; one or a plurality of diameter attributes which are obtained from the measurements along the circumference of the coiled tubing section; one or a plurality of polar angle attributes which identify the circumferential positions of wall thickness and the diameter attributes, wherein the polar angles for the wall thickness attributes may or may not correspond to that of the diameter attributes; one polar angle attribute that identifies the location of the seam weld location along the circumference of the coiled tubing section; and a time attribute that identifies when the measurements are or were taken. Other methods of the invention include adding real time or near real time data to the geometric database during the provision of the coiled tubing services, methods including comparing data in the geometric database with real time data to determine changes in the coiled tubing, and wherein the coiled tubing services are selected from acidizing, fracturing, high pressure operations, coiled tubing assisted drilling, and clean-out procedures using coiled tubing. Other methods include monitoring the real time or near real time coiled tubing mechanical integrity by using the measurements to determine the in-situ coiled tubing triaxial stress limits (for coiled tubing under the combined loadings of axial tension or compression, bursting pressure or collapse pressure) as well as the fatigue life of coiled tubing; and using the real time measurement, and/or real time mechanical integrity monitoring to provide an active feedback control of the movement of coiled tubing through controlling the movement of the coiled tubing injector.

The methods of the invention will become more apparent upon review of the brief description of the drawings, the detailed description of the various embodiments of the invention, and the claims that follow.

BRIEF DESCRIPTION OF THE DRAWINGS

The manner in which the objectives of the invention and other desirable characteristics can be obtained is explained in the following description and attached drawings in which.

Figure 1A:
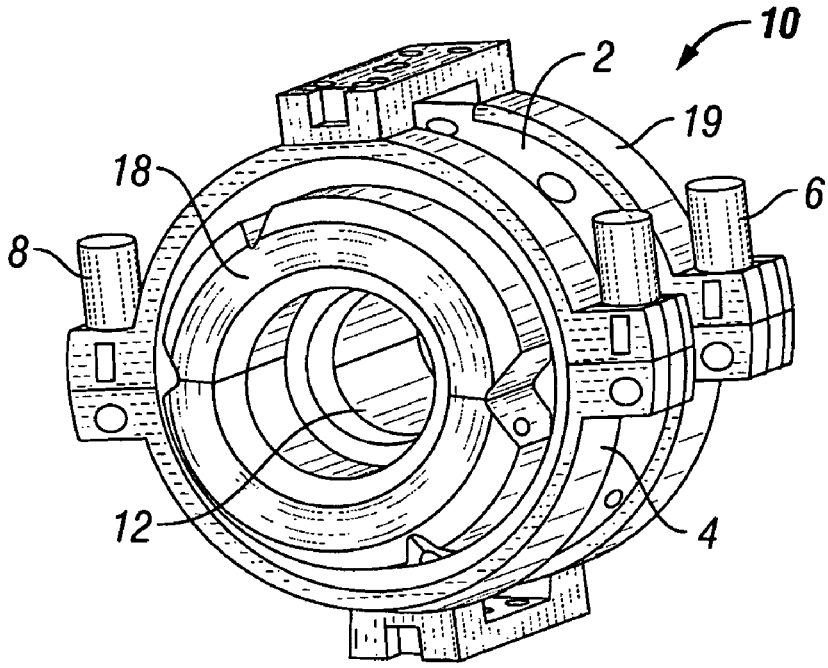
FIG. 1 illustrates a perspective view of a coiled tubing inspection apparatus useful in the methods of the invention.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. For example, in the discussion herein, aspects of the inventive methods and apparatus are developed within the general context of inspection of coiled tubing and using the data in real time or near real time, which may employ computer-executable instructions, such as program modules, being executed by one or more conventional computers. Generally, program modules include routines, programs, objects, components, data structures, etc. that perform particular tasks or implement particular abstract data types. Moreover, those skilled in the art will appreciate that the inventive methods and apparatus may be practiced in whole or in part with other computer system configurations, including hand-held devices, personal digital assistants, multiprocessor systems, microprocessor-based or programmable electronics, network PCs, minicomputers, mainframe computers, and the like. In a distributed computer environment, program modules may be located in both local and remote memory storage devices. It is noted, however, that modification to the methods and apparatus described herein may well be made without deviating from the scope of the present invention. Moreover, although, developed within the context of inspecting coiled tubing, those skilled in the art will appreciate, from the discussion to follow, that the inventive principles herein may well be applied to other aspects of inspection of tubular members. Thus, the methods and apparatus described below are but illustrative implementations of a broader inventive concept.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes apparatus and methods for inspecting coiled tubing and using the data obtained in real time or near-real-time. In one aspect, the present invention uses real time coiled tubing geometric measurements (wall thickness, tubing diameters, and the like) to improve coiled tubing operation safety. Various embodiments of the present invention comprise one or more of the following features:

establishing and using a geometric database for the coiled tubing string using measurement data and trending analysis;

using the geometric database for coiled tubing operation job design;

monitoring, in real time or near real time, the status of tubing dimensions (thickness, diameter, ovality, shape) during a coiled tubing operation;

using the real time measurements to identify potential defects on the coiled tubing and to evaluate the criticality of the defect with regard to the intended operation;

monitoring the real time or near real time coiled tubing mechanical integrity by using the measurements to determine the in-situ coiled tubing triaxial stress limits (for coiled tubing under the combined loadings of axial tension or compression, bursting pressure or collapse pressure) as well as the fatigue life of coiled tubing;

using the real time measurement, and/or real time mechanical integrity monitoring to provide an active feedback control of the movement of coiled tubing through controlling the movement of the injector, and/or provide an active feedback control of the coiled tubing operation through controlling key operation parameters, such as the speed of injector, circulating pressure, wellhead pressure, etc.; and using the real time measurement, in conjunction with the history measurement from the geometric database to perform trending analysis and using such trending information to improve job design and planning, and/or to use such trending information for pricing of a particular service.

Other embodiments of the present invention comprise features such as updating the geometric database during the use of the coiled tubing. In one embodiment, this updating may include appending new data to the database. In another embodiment, this updating may include deleting sections of the database to take into account removal of sections of coiled tubing. Such sections of tubing may be removed, for example, when a lower section of tubing is exposed to significantly more fatigue or wear. Sections of tubing may also be removed during routine operations to sever connectors from the tubing. In another embodiment, this updating may include combining two databases into one such as when welding two lengths of coiled tubing. This updating may be done while the tubing is in the wellbore, but could also be done between jobs.

The methods described herein may be beneficial to all coiled tubing operations and are particularly useful for applications such as hydraulic fracturing, well bore clean out, coiled tubing drilling, matrix acidizing and other abrasive or corrosive environments. Significant benefits may be gained by use of these methods to reduce operation failures and difficulties. Abrasive and corrosive materials inside the coiled tubing are known to affect the wall thickness measurement, either because those materials change the actual thickness, or because they change the material properties of the metal. Carbon dioxide ($CO_2$) and hydrogen sulphide ($H_2S$) are common examples of such materials encountered during well servicing. $CO_2$ combines with water to form carbonic acid, which is very aggressive to steel and results in large areas of rapid metal loss, which can be detected by ultrasonic measurements such as wall thickness and time-of-flight. $CO_2$ generated corrosion pits are round based, deep with steep walls and sharp edges, so that an eddy-current technique can be used to detect them. Occasionally, the pits will be interconnected giving a bigger back-scatter effect on an ultrasonic signal. $H_2S$ can affect an ultrasonic measurement in three ways. $H_2S$ generated pits are round based, deep with steep walls and beveled edges. They are usually small, random, and scattered over the entire surface of the tubing. As such they will cause less focused backscattering and a general reduction in amplitude of the ultrasonic measurement. A second corrodent generated by $H_2S$ is iron sulfide scale. The surface of the tubular may be covered with tightly adhering black scale which can affect the reflection properties of any ultrasonic signal. Iron sulfide scale is highly insoluble and cathodic to steel which tends to accelerate corrosion penetration rates. A third corroding mechanism is hydrogen embrittlement, which causes the fracture surface to have a brittle or granular appearance. A crack initiation point may or may not be visible and a fatigue portion may not be present on the fracture surface. A shear induced hydrogen embrittlement failure can be immediate due to the absorption of hydrogen and the loss of ductility in the steel, so this kind of damage is extremely important to detect. Methods based on ultrasonic time-of-flight, thickness mapping, backscatter detection and velocity ratio were recommended by R. Kot in "Hydrogen Attack, Detection, Assessment and Evaluation" at the 10th APCNDT Conference in Brisbane, 2001. Other papers and presentations detailing the effects of corrosion on ultrasonic measurements are well known in the industry. We cite three such for exemplary purposes: G. R. Prescott, "History and basis of Prediction of Hydrogen Attack of C-½ Mo Steel", Material Property Conference, Vienna, Oct. 19-21, 1994, A. S. Birring, et al. "Method and Means for Detection of Hydrogen Attack by Ultrasonic Wave Velocity Measurements" U.S. Pat. No. 4,890,496, Jan. 2, 1990; and A. S. Birring and K. Kawano, "Ultrasonic Detection of Hydrogen Attack in Steels", Corrosion, March, 1989. In many cases, these corrosion-induced changes can complicate the interpretation of an ultrasonic evaluation, because some of their effects can cancel each other out. Measurements over time can help isolate individual effects. So it would be an advance in the art to be able to extract from a geometric database any anomalous changes in wall-thickness or back-scattered amplitude at certain points along the coiled tubing, and monitor those changes over time. Because coiled tubing may be used continuously running in and out of a wellbore, it is the geometry database that makes this defect monitoring possible.

As used herein the term "database" means a collection of data elements stored in a computer in a systematic way, such that a computer program can consult it to answer questions or provide information. A database may be stored in the memory of a computer, written to a storage device, or both. The simplest database structure is a listing of the elements in an array or tabular fashion such as a matrix held in memory or a spreadsheet written to a file. Such databases are termed flat. Other useable database formulations include hierarchical structures, relational structures, fuzzy-logic structures and object-oriented structures. See for example the textbook "An Introduction to Data Structures and Algorithms," by J. A. Storer, published by Birkhauser-Boston in 2002. Other database structures are foreseeable by those skilled in the art, and these database structures are considered within the literal scope of the various embodiments of the invention.

As used herein the term "inspecting" means finding or at least determining the presence of one or more of pits, cracks, welds, seems, axial defects, wall thinning, ovality, diameter changes, and the like. In certain embodiments, the term "inspecting" also means measuring the dimensions of the tubing, such as wall thickness and diameter. In still other embodiments, "inspecting" may also include determining the size and/or depth of a defect, or the presence of embrittlement or weakening of the material properties of the steel.

"Real-time" means dataflow that occurs without any delay added beyond the minimum required for generation of the dataflow components. It implies that there is no major gap between the storage of information in the dataflow and the retrieval of that information. There may be a further requirement that the dataflow components are generated sufficiently rapidly to allow control decisions using them to be made sufficiently early to be effective. "Near-real-time" means dataflow that has been delayed in some way, such as to allow the calculation of results using symmetrical filters. Typically, decisions made with this type of dataflow are for the enhancement of real-time decisions. Both real-time and near-real-time dataflows are used immediately after the next process in the decision line receives them.

Given that safety is a primary concern, and that there is considerable investment in existing equipment, it would be an advance in the art if coiled tubing inspection could be performed using existing apparatus modified to increase safety and efficiency during the procedures, with minimal interruption of other well operations. The present invention comprises methods of using geometry measurement data that may be obtained from a geometry measurement device to improve the operation safety of coiled tubing operation. The methods described herein can be used individually to improve the operation safety. Any two or more (including all) of them can also be used simultaneously to improve the operation safety.

Figure 1B:
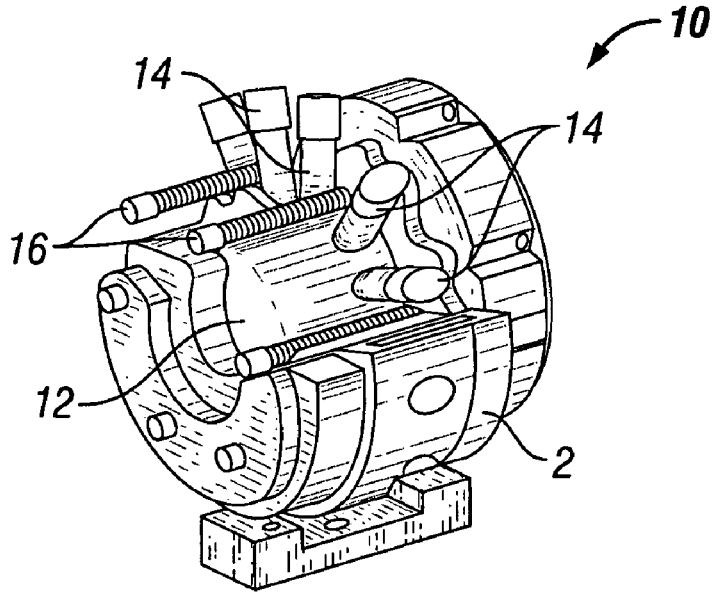

Referring now to the figures, FIGS. 1A and 1B illustrate schematically and not to scale perspective views of an apparatus 10 useful in the invention, with portions cut away in FIG. 1B. It will be understood that the practice of the methods of the invention are not limited to gathering data using this apparatus, and that other inspection devices may work just as well, alone or in combination with apparatus 10. Apparatus 10 includes two generally half cylindrical members 2 and 4 forming a passageway for the tubing. Clamps 6 and 8 secure half cylinders 2 and 4 together. The passageway formed between half cylinders 2 and 4 may include a tubular elastomeric element 12 adapted to protect the internal surfaces of half cylinders 2 and 4, as well as provide some cushion and wear resistance, and hold ultrasonic probes 14 in place, as illustrated in FIG. 1B. Ultrasonic probes 14 measure geometric data regarding the coiled tubing. In this case there are sixteen probes equally positioned around the circumference of the apparatus. Probes 14 may measure a plurality of wall thicknesses and diameters along the circumference of coiled tubing as the coiled tubing traverses through the apparatus, or the apparatus traverses past the tubing. A series of bolts 16 helps secure two end elements 18 and 19 together.

Other ferrous tubular member inspection apparatus may be used to gather coiled tubing inspection data, either alone or in conjunction with the apparatus illustrated in FIGS. 1A and 1B. The pipe inspection equipment may include gamma ray sensors which are commonly used to detect wall thickness defects. Methods based on ultrasonic time-of-flight, wall thickness mapping, backscatter detection and velocity ratio can be used to evaluate, detect and assess hydrogen attack and embrittlement. Ultrasonic techniques can also be used to detect the presence of scale or sulphide accumulation on the inside of the tubular. Magnetic flux leakage devices are also known in the ferrous tubular member inspection art, and one or more of these maybe employed alone or in combination with the ultrasonic inspection apparatus illustrated in FIGS. 1A and 1B, or with other ultrasonic inspection apparatus. Typical magnetic flux leakage detection systems induce a magnetic field in a ferrous tubular member that is then sensed by a bank of magnetic field sensors such as search coils. Sensors pick up the changes in the magnetic field caused by flaws and produce signals representative of those changes. An analog or digital processor inputs the magnetic field signals and filters them to remove noise. The sensors used may be magneto diodes, magneto resistors, and/or Hall elements, and are typically placed in "shoes" that ride along the outside surface of the tubular member.

Various so-called tubing trip tools have been devised that measure tubing average wall thickness, local defects, such as corrosion pitting, and longer axial defects during removal of the tubing from the well. In these trip tools, a uniform magnetic property is induced in at least a portion of the tubing. Applying an appropriate uniform magnetizing field induces an appropriate longitudinal magnetic field. The magnitude of the electric signal integral from this field determines the tubing wall thickness. Flux leakage in the longitudinal magnetic field is related to the presence of local defects, such as corrosion pitting. The shape of the flux leakage field is determined, for example by geometric signal processing, to quantify the depth of the local defects. In one known apparatus, multiple flux leakage detecting elements, such as the afore-mentioned magneto diodes, magneto resistors, or Hall effect probes, are used to determine two different derivatives of the flux leakage, and the depth of the local defects, such as corrosion pits, is a function of both different derivatives evaluated at their local maximums. The presence of axial defects, having an axial dimension in excess of the local defects, may be determined by applying a fluctuating magnetic field in addition to the first uniform magnetic field. Driven fields induced in the tubing element by the fluctuating field are then used to measure the axial defects. Two coils having sinusoidal distributions of different phases around the tubing can be used to generate the fluctuating fields. The driven fields are also detected by using two sinusoidal detector coils having sinusoidal conductor distributions of different phases. The applied fluctuating field is rotated around the tubing using stationary coils and the presence of axially extending defects at various angular positions can be detected using the technique.

Figure 2:
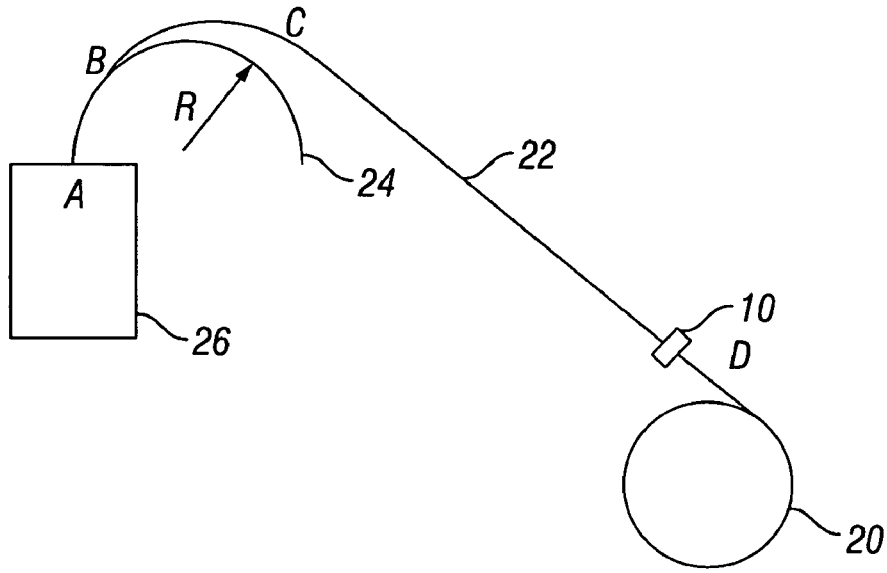
FIG. 2 is a schematic block diagram of a general set up for using the coiled tubing inspection apparatus of FIG. 1 to inspect a coiled tubing string.

FIG. 2 is a schematic block diagram, not to scale, of a general set up for measuring coiled tubing geometric data using an apparatus 10 such as illustrated in FIGS. 1A and 1B. (The same numerals are used throughout the drawing figures for the same parts unless otherwise indicated.) Illustrated in FIG. 2 is a coiled tubing 22 being unwound from a coiled tubing reel 20 by an injector 26 through a gooseneck 24, as is known in the art. Apparatus 10 is illustrated in one position that may be useful in taking geometric measurements in accordance with the various methods of the invention. Those skilled in the art will realize other useful locations for placement of apparatus 10 for accomplishing the same function, and these alternatives are considered within the inventive methods. Some of the benefits of apparatus 10 positioned as shown, as coiled tubing 22 is unwound from reel 20, are discussed herein below.

Geometry Database and Trending Analysis

Figure 3:
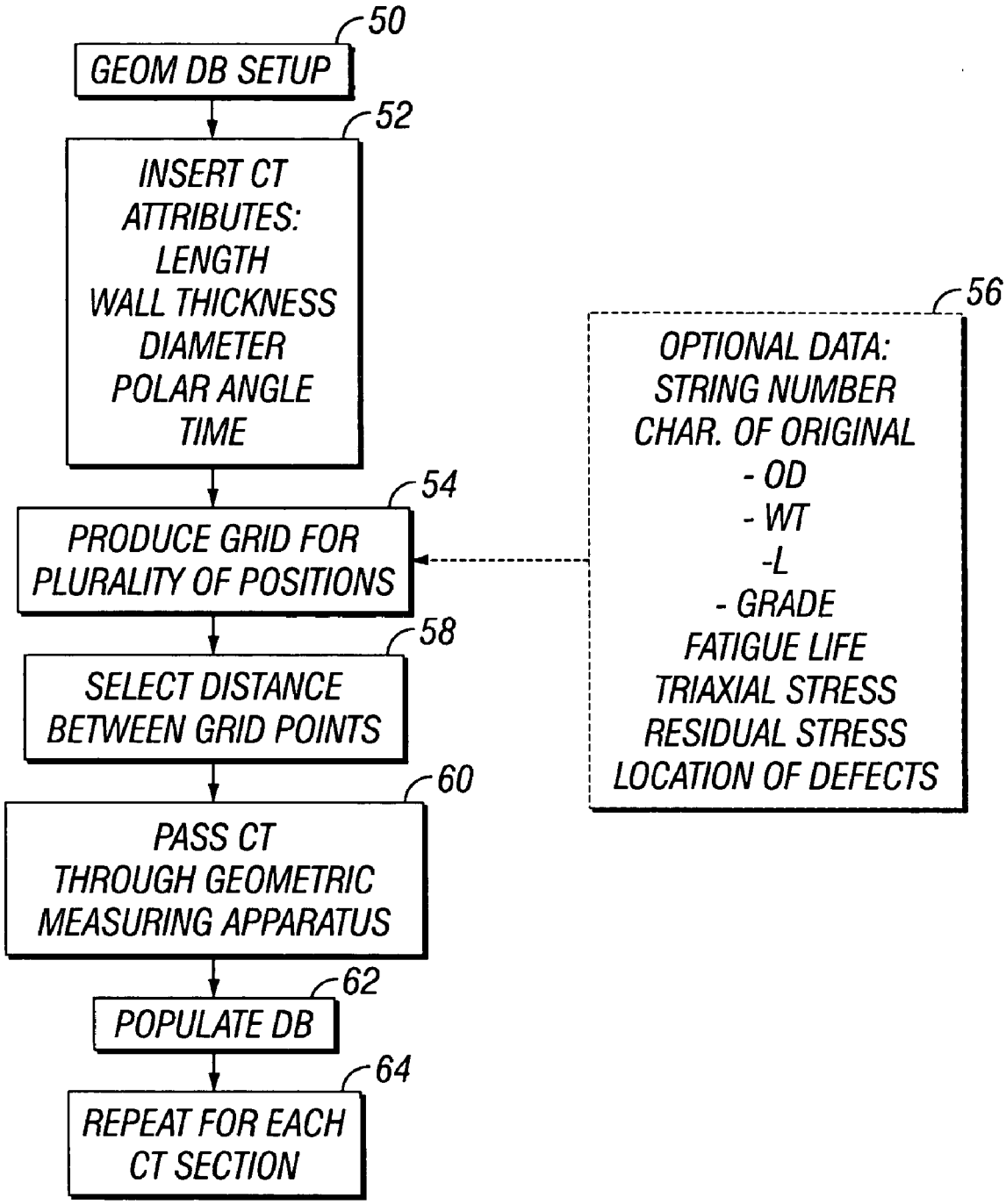

Referring to FIG. 3, one method of the invention is to establish a coiled tubing geometry database 50 based on real time or near real time geometry measurements 52. The geometry database may comprise at least one or more of the following attributes:

- a length attribute that identifies the exact location (thereafter "section") along the coiled tubing string where the geometry attributes belong to;
- one or a plurality of wall thickness attributes which are obtained from the measurements along the circumference of the coiled tubing section;
- one or a plurality of diameter attributes which are obtained from the measurements along the circumference of the coiled tubing section;

one or a plurality of polar angle attributes which identify the circumferential positions of wall thickness and the diameter attributes. The polar angles for the wall thickness attributes may or may not correspond to that of the diameter attributes;

one polar angle attribute that identifies the location of the seam weld location along the circumference of the coiled tubing section; and a time attribute that identifies when the measurements are or were taken.

It is important to note that the various embodiments of the invention do not rely upon any specific organizational structure for the database to the exclusion of all other possible organizational structures. For example, in one embodiment the database may be indexed according to axial length along the tubing with the geometric data sampled uniformly along the coil, such as every six inches. Uniform sampling is not a necessary feature of the invention, however. For example, when two pieces of coiled tubing are welded together a new database is created. Appending one dataset could most simply create this, but then the resulting database would not be uniformly sampled. Alternatively, the second dataset could be resampled to match the sampling of the first dataset. Appending this resampled dataset may result in a uniformly sampled third dataset, but at the cost of doing that resampling. In another embodiment, the data may be indexed by polar angle, which would allow very rapid access to, say, all of the data 180 deg from the weld seam. In yet another embodiment the data may be broken into a multi-layer hierarchy so that the first entry may be the global average along the whole length of the coil, the second entry may be the difference of that global average from the average along just the first half of the coil, and the third entry may be the difference between the global average along the second half of the coil, and so on, with the coil being divided up into successive powers of two. This is similar to saving the Fourier transform of the data rather than the data itself. This multi-layer organization may also be performed using polar indexing, in which case the first set of data may be the azimuthal average, the second may be the variation from that average, and so on.

Thus, a grid 54 may be generated for a plurality of positions along a coiled tubing string. The location of each grid point, together with the coiled tubing sectional geometry data at each grid point, may be stored in the geometry database. The distance between two adjacent grid points is selected at box 58. The distance may vary with the particular degree of interest in the coiled tubing, with time available, with contract requirements, with the fluid or fluids to be conveyed by the coiled tubing, and many other factors. In some embodiments the distance between two adjacent grid points may be as small as 1 centimeter; in other embodiments, a distance of 3 meters or less may suffice. The distance could be greater than 3 meters. The distance could be uniform over the length of the tubing, or could vary randomly. Each geometry database may correspond to one coiled tubing string or a plurality of strings. The geometry database may contain only one set of the latest measurement data, or it may contain one set of the latest measurement data, plus one or a plurality of previous measurement data.

A coiled tubing section is then passed through a geometric measuring apparatus (box 60) to populate the database (box 62). The method is repeated (box 64) as necessary for all or a portion of the coiled tubing sections. Other optional attributes, some of which are listed in box 56, may be added into the geometry database. For example, one or more of the following attributes may also be included in the geometry database:

a string number attribute may be included to identify the particular coiled tubing string;

one or a plurality of attributes which identify the original (as-manufactured) coiled tubing string makeup, such as OD, nominal wall thickness, section length, tubing grade, and the like;

one or a plurality of attributes that identify the fatigue life, triaxial stress status, residual stress status, and the like; and one or a plurality of attributes that identify where a particular section of coiled tubing has defects.

Once the geometry database is set up, it is populated by the measurement data taken from a geometry measurement device, such as that described in FIGS. 1A and 1B. The geometry database associated with a coiled tubing string may be used to analyze any defects, changes or sudden changes in geometry, and mechanical integrity. When measurement data from successive measurements are stored in the geometry database, trending analysis may be conducted by comparing the evolution of geometry changes with various coiled tubing operation conditions. Results from the trending analysis can be used to optimize operation procedures to reduce damage on the coiled tubing. Certain methods of the present invention are also useful for calculating and estimating prices for the coiled tubing services.

Job Design Using Geometry Database

Figure 4:
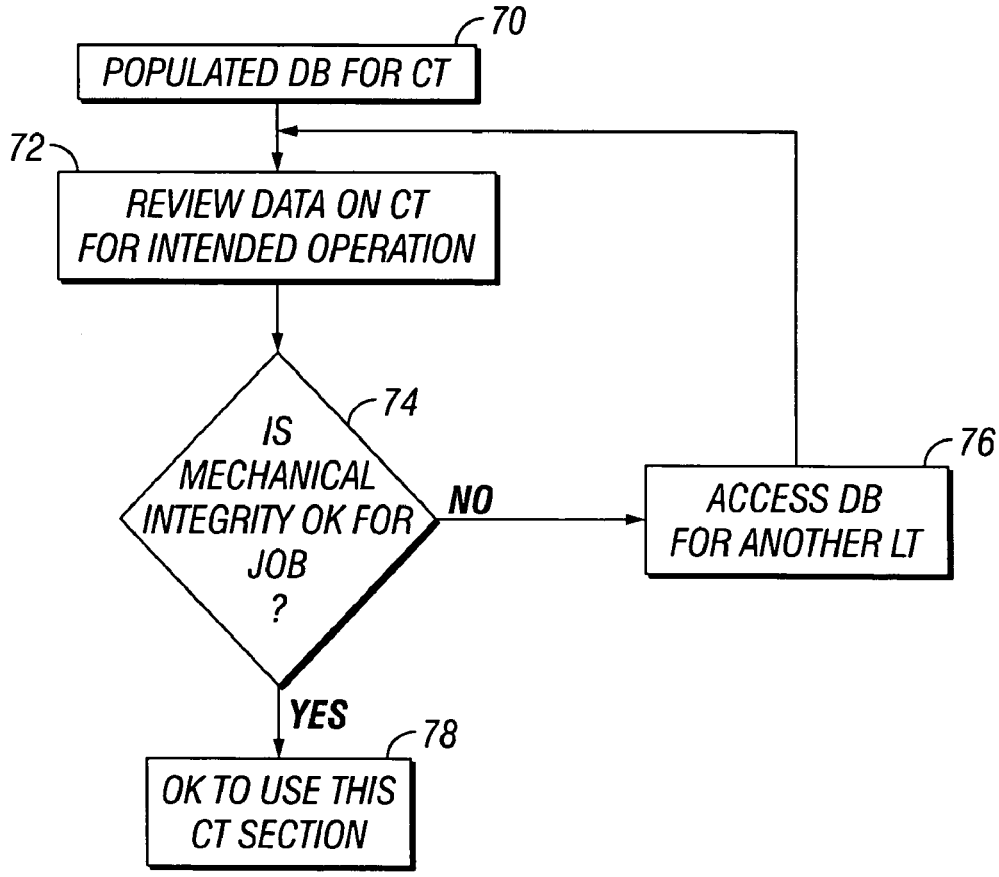
FIGS. 3-5 are logic diagrams illustrating some of the features of the methods of the invention.

Referring to FIG. 4, the availability of geometry measurement, together with the establishment of a geometry database 70, allows one to design a coiled tubing job using the most relevant geometry information. Currently, the prevailing method to design a coiled tubing job is to use the nominal or the minimal coiled tubing dimension (as published in the manufacturers' product catalog). Since coiled tubing experiences changes in dimensions during operation, relying on nominal or minimal coiled tubing dimension to do job design may not be safe for its intended operation. For example, hydraulic fracturing through coiled tubing often leads to loss of tubing wall thickness due to erosion. Since hydraulic fracturing often subjects the coiled tubing to high operating pressure, using the nominal or even the minimal wall thickness of a coiled tubing string, which has been used in hydraulic fracturing before, to design the next hydraulic fracturing job would likely over estimate the burst and collapse pressure capacity of the coiled tubing. Such overestimation would potentially cause catastrophic failure during hydraulic fracturing.

Another use for the most recent geometry database as well as the historical records of geometry database is to improve job design for coiled tubing operations, for example matrix acidizing applications. By reviewing (box 72) and using the most up to date geometry database for coiled tubing job design, risk associated with wall thickness loss and corrosion pitting can be significantly reduced. By tracing the loss of wall thickness through successive acidizing application, a fairly accurate estimate of wall thickness loss or the occurrence or growth of a corrosion pitting for the upcoming job may be assigned for the coiled tubing during the design stage, further reducing the risk associated with the potential reduction of coiled tubing mechanical integrity. Data may be reviewed to determine (box 74) if the coiled tubing section in question has the mechanical integrity necessary to complete a particular coiled tubing operation. If yes, then the software informs (box 78) an operator that it is acceptable to use this section of coiled tubing. If the mechanical integrity is determined not to be acceptable, the operator may access the geometric database to analyze or locate another coiled tubing string, as represented by box 76.

In summary, with the geometry measurements and geometry database, the most up to date geometry information can be used to design coiled tubing, which correctly reflects the mechanical integrity of the coiled tubing. Hence, overestimation of mechanical integrity is eliminated or reduced, and potential for catastrophic failure due to inaccurate geometry information is significantly reduced.

Real Time Monitoring of Coiled Tubing Geometry

Figure 5:
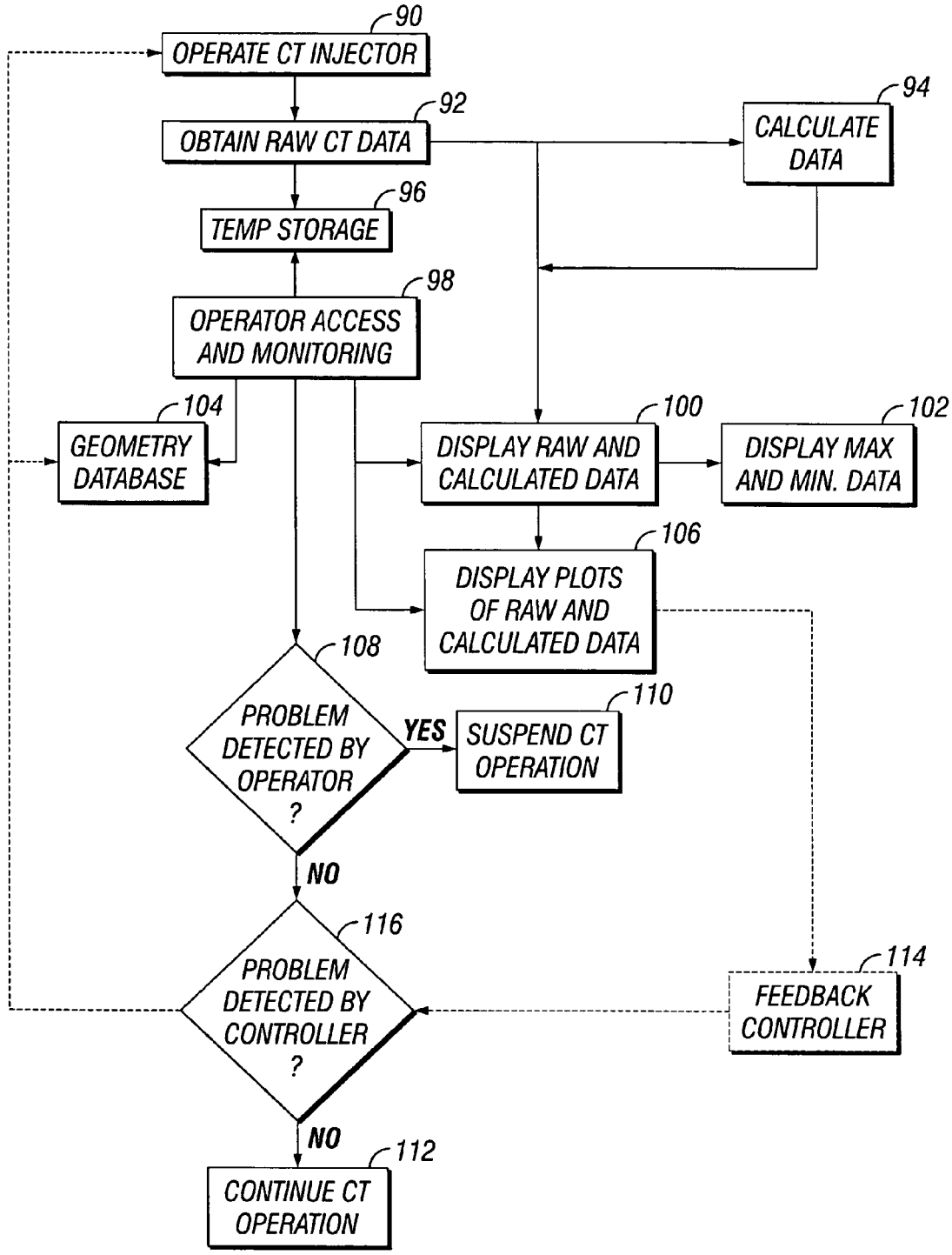

Referring to FIG. 5, the geometry measurement data, when taken during coiled tubing operation, may be used to provide real time monitoring of coiled tubing geometry. A coiled tubing injector is operated, indicated at box 90, to inject coiled tubing for a particular operation, while a geometric measuring device obtains data, box 92, which may include a calculation unit to produce calculated data 94. The raw data may be temporarily stored at 96, as explained herein. An operator 98 may access and monitor data in temporary storage 96, as well as access and monitor displays of raw and calculated data 100, a display of maximum and minimum values at box 102, and geometry database 104. An operator may also review displays of plots of raw and/or calculated data, as well as trend analysis (not illustrated). An operator may decide (box 108) whether or not a problem exists, and if yes, suspend the coiled tubing operation (box 110), or alter operation parameters. If the operator detects no problem, the coiled tubing operation is continued (box 112). Optionally, a software program can be developed that provides one or a plurality of human interfaces to display the measurement data on a monitor (CRT monitor, or LCD monitor, etc). The display may plot the any specific measured features (such as wall thickness, or diameter) versus time or coiled tubing depth. It may also plot the maximum and/or the minimum values of the measured features (such as maximum/minimum wall thickness, maximum/minimum diameter) against time or coiled tubing depth. It may further display any calculated values from these measured features, such as the ovality, against time or coiled tubing depth. From the measurement data, it may re-construct the shape of the cross section of the coiled tubing. The software also may comprise a feedback controller 114 that may compare set point values versus raw and/or calculated data and ask (box 116) if a problem exists. Once again, if no problem is determined, the coiled tubing operation continues (box 112). However, if a problem exists, the controller may send a signal to the coiled tubing injector 90 to stop, slow down, or take some other action, and this may be reported to the geometry database 104.

Since all plots 106 may be displayed in real time during coiled tubing operation, the coiled tubing operator can use them to visualize any anomaly on the coiled tubing string, such as sudden change in coiled tubing diameter, significant loss of wall thickness, or unusual deformation of the coiled tubing cross section (change in shape). This information provides a powerful tool for the operator to make real time decisions as to whether the operation should be continued or whether more detailed inspection of the coiled tubing is needed before operation resumes.

The real time measurement data, in conjunction with real time operation data, such as coiled tubing running speed, wellhead pressure and circulation pressure, etc, can be used to provide a look-ahead evaluation of operation risk for the immediate operation. When these information are combined with a real time tubing integrity evaluation tool (such as a software tool to predict a tubing's mechanical limits, etc), the operator may have advanced knowledge of a potential upcoming risk for the coiled tubing before it is subjected to the risk. This should greatly enhance the operation safety as the operator should have adequate response time to avert any impending risk.

The software program that provides all these real time plots of various parameters, which may be any commercially available plotting program, may save these parameters into the geometry database 104, which resides inside the computer hardware, as any new measurement arrives. Alternatively, it may temporarily keep all or a portion of these real time measurements in the computer memory for ease of access during the operation, as indicated at 96. Either way, the software program may support the feature that allows the review of previously measured data at a different coiled tubing location, while the measurement device may or may not continue to acquire new measurement data as the coiled tubing may or may not be moving during the operation. With this feature, if an operator just identifies a problematic section while the coiled tubing is moving a typically speed of 15-45 meters/min (50-150 ft/min), the operator may temporarily suspend the movement of coiled tubing, review the previously identified problematic section and then decide whether the operation can be proceeded safely.

At the end of the coiled tubing operation, or at the end of the measurement, the program may be designed such that it automatically saves some or all the measurement data into the geometry database 104. It may also be programmed to save any associated defect information, operator evaluation note, etc. into one or a plurality of computer files, which is properly identified with the associated geometry database. Alternatively, the program may provide an option allowing the operator to decide whether the newly measured data should be saved into the geometry database and associated computers. When saving these data into a geometry database, the program may provide an option that the program either overwrites the previously saved geometry database with the new measurements, or saves the new measurement data as a new geometry database entry with appropriate timestamp while maintaining the previously saved geometry database.

With the ability to identify the location of a seam weld, software programs useful in the invention may also be used to determine whether a coiled tubing string has experienced rotation during operation. Information about coiled tubing rotation plays an important role in the fatigue life of the coiled tubing, which will be discussed below.

Real Time Monitoring and Evaluation of Defects

One or a plurality of computer software programs may also be developed to provide real time monitoring and evaluation of defects. For example, the software program may use the real time measured data to decide whether a change in wall thickness on the same coiled tubing section occurs, which could indicate one or a plurality of localized defects along the circumference of the coiled tubing. The software may also be used to determine whether a sudden change in wall thickness along the coiled tubing occurs, which could indicate one or a plurality of localized defects lengthwise along the coiled tubing string.

The formula to identify localized circumferential defects may take the form of an Inequality (1):

$$\left|\frac{t_i^j - t_{i+1}^j}{t_i^j}\right| > \zeta \tag{1}$$

where t is the wall thickness measurement along the circumference, subscript (i) is the index identifying a particular measurement on the circumference, superscript (j) is the index identifying a particular coiled tubing section, ζ is a preset constant for localized defect identification. At any particular circumferential location (i), if the condition of the Inequality (1) is satisfied, the location may be tagged as having a localized defect of sudden wall thickness change nature. Similarly, the formula to identify localized defects lengthwise along the coiled tubing string may take the form of an Inequality (2):

$$\left|\frac{t_i^j - t_i^{j+1}}{t_i^j}\right| > \eta \tag{2}$$

where η is a preset constant for localized lengthwise-defect identification. At any particular coiled tubing section, if condition of the Inequality (2) is satisfied and if the coiled tubing section is not at the junction of a tapered tubing section with two differing wall thicknesses, the section may be tagged as having a localized lengthwise-defect of sudden wall thickness change nature.

Other similar defect identification schemes may be included in the software to provide a comprehensive monitoring, identification and evaluation of various coiled tubing defects. These defect identification schemes, when applied on successive geometry databases, such as a geometry database that is being generated from the real time measurement data and the geometry database that was created from last coiled tubing operation, a new trend analysis may be provided to analyze the evolution of any particular defect. For example, if by comparing the wall thickness of a defect from the last operation (last measurement) and that of the current operation (this measurement), the wall thickness of this particular defect has lost 2.5 mm (0.0 in), and if a similar service is performed in both operations (such as hydraulic fracturing), it can be inferred that after this operation, the wall thickness at the location of this defect may be reduced by another 2.5 mm (0.01 in). With this information at hand, the operator will be able to evaluate the risk associated with a particular operation and decide whether this operation can be continued.

Real Time Mechanical Integrity Monitoring

One or a plurality of computer software programs may be developed to determine coiled tubing mechanical integrity using the real time measurement data. For example, software may be used to determine the working envelope (limit) of coiled tubing under the combined loadings of axial force (tension or compression) and/or internal (burst) and/or external (collapse) pressure. Traditionally, such a working envelope is often calculated based on the nominal or the minimal dimensions of the coiled tubing, which may not accurately identify the in-situ working envelope of the coiled tubing. An example on how to determine such a working envelope can be found in a reference paper "Improved Model for Collapse Pressure of Oval Coiled Tubing" by A. Zheng, SPE 55681, published in SPE Journal, Vol. 4, No. 1, March 1999. When the real time measured data of coiled tubing geometry are used to determine such a working envelope, it eliminates the risk of over-estimation and reduces the chance of operation failure. Another coiled tubing mechanical monitoring software, coiled tubing fatigue life prediction software, will also benefit from the real time measurement of coiled tubing geometry. When the real time measured data is used in updating the consumption of coiled tubing fatigue life, the calculated fatigue life will be more accurate and risk of over-estimation is greatly reduced. It has been generally recognized that many catastrophic operation failures are due to inaccurate prediction of coiled tubing working limits or fatigue life as a result of using an assumed coiled tubing geometry, leading to significant economic loss. The use of real time geometry data will eliminate or greatly reduce the risk of such catastrophic failure and associated economic cost.

Since the measurement device is typically located at a distance from the coiled tubing injector (from several meters to tens of, in rare occasion, hundreds of meters), the real time mechanical integrity monitoring can be used to predict whether the coiled tubing can be used for its intended operation. Take the example of coiled tubing working envelope, when the coiled tubing passes the measurement device, a real time working envelope can be generated. At the same time, the computer software obtains the current operation parameters, such as surface weight, coiled tubing depth, wellhead pressure and circulating pressure. Thus right before the concerned section of coiled tubing is subjected to the loading of axial force (as a result of weight), and/or wellhead pressure, and/or circulating pressure, the software can determine whether these upcoming operation parameters (axial force, wellhead and/or circulating pressures) could strain the coiled tubing beyond its working envelope. If these upcoming operating parameters could strain the coiled tubing beyond its working limit, the program could alert the operator such that a corrective action can be taken, either through changing the operating parameters or the suspension of the coiled tubing operation. All these may happen even before the concerned coiled tubing is subjected to the intended loadings, thus operation safety is ensured. Similar real time monitoring and impending failure warning features can be implemented for other integrity monitoring system, such as for the coiled tubing fatigue life monitoring. Alternatively, the whole process of defect detection, alarm warning and manual operator responses can be implemented through an automated feedback control loop, such that, when a condition is satisfied that requires operator intervention, the automated feedback control loop will initiate the necessary actions (such as slow down or stop the operation, increase or decrease an operation pressure, etc) by itself without any active involvement of the operator. This would provide an added benefit as an automated feedback control usually has a faster response time than an operator's manual response.

The use of real time mechanical integrity monitoring could enable coiled tubing operators to optimize "on the fly", or modify operation parameters to avoid potential operation failure. This feature may be particularly critical for mission critical services such as hydraulic fracturing or matrix acidizing through coiled tubing, where significant wall thickness loss or the existence of corrosion cracks/pitting is likely to happen, hence the mechanical integrity of the coiled tubing is likely to be compromised during operation. For example, during hydraulic fracturing, if the measurement device detects significant wall thickness loss, consequently, the real time mechanical integrity monitoring determines an impending failure under the existing operation parameters, the operator could then reduce the treating pressure, or the wellhead pressure to reduce the risk of a burst or collapse failure. Another example is for matrix acidizing treatment. If the measurement device detects significant wall loss or the existence of corrosion crack/pitting, consequently, the real time mechanical integrity monitoring may determine an impending failure under the existing operation parameters, and the operator may reduce the treating pressure, and/or wellhead pressure, and/or surface weight, etc. to reduce the risk of the operation failure. Alternatively, the whole process of defect detection, alarm warning and manual operator responses can be implemented through an automated feedback control loop, as explained in the previous paragraph.

Real Time Feedback Control of Coiled Tubing Injector

Real time monitoring of coiled tubing geometry, and/or real time evaluation of coiled tubing defects, and/or real time mechanical integrity monitoring may be used to provide real time feedback control for coiled tubing operations. When an impending defect is significant enough to cause potential harm to the coiled tubing operation, such information may be fed into a process control system to automatically affect the operation parameters without direct intervention from the operator. For example, when the real time geometry monitoring or defect evaluation software identifies a particular section of coiled tubing with ballooned diameter that would prevent the coiled tubing from being inserted into the injector or the stripper, such information is passed on to the control system, which may issue a command to stop the injector movement, thus stopping the movement of the concerned coiled tubing section even before it enters the injector or the stripper. The real time mechanical integrity monitoring and impending failure warning feature can also be integrated with the automated process control of the coiled tubing operation. When the software detects a problem and issues an impending warning signal, the signal may be intercepted by the process control system, again, without the active intervention of the coiled tubing operator, and the process control system may issue a command to stop the movement of the injector, thus stopping movement of the coiled tubing, even before the failure occurs. The process control system may also issue a command to alter one or a plurality of operation parameters, such as coiled tubing running speed, circulation pressure or wellhead pressure to reduce the likelihood of a potential failure. It is possible that upon receiving any warning signals from various monitoring systems, the process control software may issue a command to stop the movement of the injector, or to run the injector in a different manner (accelerate or decelerate, run at higher or lower speed), or to reverse the direction of injector movement, or to alter any operationparameters, in order to avoid or alleviate the impending problem.

The integration of real time coiled tubing geometry monitoring, and/or real time defect evaluation, and/or real time mechanical integrity monitoring into a monitoring system with automated process control of coiled tubing operation brings about a new level of improved operation safety and service quality. This may be particularly true for critical applications, such as hydraulic fracturing, coiled tubing drilling and matrix acidizing. In hydraulic fracturing, when the monitoring system detects the loss of wall thickness and determines that the mechanical integrity of the coiled tubing has been compromised and the coiled tubing is unsuitable for the ongoing operation parameters (sign of an impending failure), a signal may be passed on to the process control system. Without any intervention from the operator, the control system may automatically reduce one or a plurality of the following parameters, i.e., treating pressure (circulating pressure), and/or wellhead pressure, and/or surface weight to the level that is safe for the coiled tubing under the current geometry conditions.

Similar applications can be found in matrix acidizing. During matrix acidizing operation, when the monitoring system detects a loss of wall thickness, and/or the existence of corrosion crack(s)/pitting(s), and determines that the mechanical integrity of the coiled tubing has been compromised and the coiled tubing is unsuitable for the ongoing operation parameters (sign of an impending failure), the monitoring system may send a signal to the process control system. Again, without any intervention from the operator, the control system will automatically reduce one or a plurality of the following parameters, i.e., treating pressure (circulating pressure), and/or wellhead pressure, and/or surface weight to the level that is safe for the coiled tubing under the current geometry conditions.

An optional feature of methods of the invention is to sense the presence of hydrocarbons (or other chemicals of interest) in the fluid traversing up a coiled tubing main passage, or a high pressure and/or temperature, for example during a reverse flow procedure. The chemical, pressure, or temperature indicator may communicate its signal to the surface over a fiber optic line, wire line, wireless transmission, and the like. When a certain condition is detected that would present a safety hazard if allowed to reach surface (such as oil or gas, or very high pressure), the reversing system is returned to its safe position, long before the condition creates a problem.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. A method comprising:

establishing a predetennined geometric database of coiled tubing data for a coiled tubing operation acquiring real time inspection data of a coiled tubing during the coiled tubing operation; and employing the real time inspection data to alter parameters of the coiled tubing operation in real-time in an automated manner.

2. The method of claim 1 wherein said establishing comprises creating a grid of spatial measurement values on a length of the coiled tubing as the coiled tubing traverses through an inspection apparatus having a plurality of sensors for detecting defects in the coiled tubing.

3. The method of claim 1 wherein said establishing comprises creating a grid of spatial measurement values on a length of the coiled tubing as the coiled tubing traverses through an inspection apparatus having a plurality of sensors for measuring coiled tubing geometric parameters.

4. The method of claim 1 wherein said establishing occurs during the coiled tubing operation.

5. The method of claim 1 wherein the coiled tubing operation is one of acidizing, fracturing, a high pressure operation, drilling, and a clean-out operation.

6. The method of claim 1 wherein the inspection data is indicative of coiled tubing triaxial stress limits for coiled tubing under a combined loading of one of axial tension/compression and bursting pressure/collapse pressure.

7. The method of claim 1 wherein said employing accounts for fatigue life of the coiled tubing.

8. The method of claim 1 wherein said employing accounts for corrosive material on the coiled tubing.

9. The method of claim 8 wherein the corrosive material includes a non-zero percentage of hydrogen sulphide.

10. The method of claim 1 wherein the parameters are one of operation pressures and movement of an injector coupled to the coiled tubing.

11. A method comprising:

establishing a predetermined geometric database of coiled tubing data for a coiled tubing operation;

acquiring real time inspection data of a coiled tubing during the coiled tubing operation;

identifying a defect in the coiled tubing from the inspection data; and stopping the coiled tubing operation in an automated manner based on said identifying.

12. The method of claim 11 wherein the inspection date relates to one of thickness, diameter, ovality, and shape.

13. The method of claim 11 wherein the coiled tubing operation is selected from acidizing, fracturing, high pressure operations, drilling, and wellbore cleanouts.

14. The method of claim 11 wherein the coiled tubing operation takes place in a wellbore containing a non-zero percentage of one of hydrogen sulphide and carbon dioxide.

15. The method of claim 11 further comprising displaying human readable trends of the inspection data.

16. The method of claim 11 wherein said acquiring is carried out during injection of the coiled tubing into a well bore.

17. The method of claim 11 wherein said stopping occurs when the real time inspection data indicates one of a substantially sudden change in a wall thickness of the coiled tubing and a substantially sudden ballooned diameter of the coiled tubing.

18. The method of claim 11 wherein the inspection data indicates a defect in a section of the coiled tubing, said stopping further comprising preventing the section from entering a downhole injector coupled to the coiled tubing.

19. A method comprising:

establishing a predetermined geometric database of coiled tubing data for a coiled tubing operation;

acquiring real time inspection data of a coiled tubing string during the coiled tubing operation;

identifying a defect in the coiled tubing string from the inspection data;

using the geometric database and the inspection data to evaluate criticality of the defect with regard to the coiled tubing operation; and altering parameters of the coiled tubing operation in real time in an automated manner based on the criticality.

20. The method of claim 19 further comprising performing a trending analysis based on said acquiring.

21. The method of claim 20 further comprising displaying the trending analysis.

22. The method of claim 19 wherein the coiled tubing operation is selected from acidizing, fracturing, high pressure operations, drilling, and clean-out.

23. A method comprising:

establishing a predetermined geometric database of coiled tubing data for a coiled tubing operation;

acquiring real time inspection data of a coiled tubing during the coiled tubing operation; and updating the predetermined geometric database based on said acquiring.

24. A method comprising:

monitoring an evolution of coiled tubing inspection data from successive coiled tubing operation runs;

performing a coiled tubing operation; and employing the evolution to alter parameters of the coiled tubing operation in real time in an automated manner.

25. The method of claim 24 wherein said employing further comprises determining the suitability of a coiled tubing string for a new operation.

* * * * *

UNITED STATES PATENT AND TRADEMARK OFFICE

CERTIFICATE OF CORRECTION

PATENT NO. : 7,357,179 B2
APPLICATION NO. : 11/212047
DATED : April 15, 2008
INVENTOR(S) : Zheng et al.

It is certified that error appears in the above-identified patent and that said Letters Patent is hereby corrected as shown below:

Column 16, Claim 1, Line 2 “predetennined” corrected to “predetermined”

Signed and Sealed this

Third Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,357,179 B2
APPLICATION NO. : 11/212047
DATED : April 15, 2008
INVENTOR(S) : Zheng et al.

It is certified that error appears in the above-identified patent and that said Letters Patent is hereby corrected as shown below:

Column 16, Claim 1, Line 40 “predetennined” corrected to “predetermined”

This certificate supersedes the Certificate of Correction issued February 3, 2009.

Signed and Sealed this

Twenty-fourth Day of February, 2009

John Doll

JOHN DOLL
*Acting Director of the United States Patent and Trademark Office*